US005509221A

United States Patent [19]

Patrick et al.

[11] Patent Number: 5,509,221

[45] Date of Patent: Apr. 23, 1996

[54] SPRAY NOZZLE ASSEMBLY FOR AN ELECTRIC IRON

[75] Inventors: Kenneth H. Patrick, Rainbow City, Ala.; Michael D. Morrissey, Bristol; Angelo J. Rainone, Wolcott, both of Conn.

[73] Assignee: Black & Decker Inc., Newark, Del.

[21] Appl. No.: 240,517

[22] Filed: May 10, 1994

[51] Int. Cl.[6] ..... D06F 75/22; B05B 1/00

[52] U.S. Cl. ..... 38/77.5; 239/570

[58] Field of Search ..... 38/77.5, 77.9, 38/77.1, 77.8; 239/570, 464, 491; 219/245

[56] References Cited

U.S. PATENT DOCUMENTS

| | | | |
|---|---|---|---|
| 2,557,901 | 12/1951 | Marlow | 239/491 |
| 3,664,045 | 5/1972 | Walker et al. | 38/77.5 |
| 3,762,647 | 10/1973 | Tada | 239/321 |
| 3,829,993 | 8/1974 | Gowdy et al. | 38/77.5 |
| 3,881,265 | 5/1975 | Eaton et al. | 38/77.5 |
| 4,018,387 | 4/1977 | Erb et al. | 239/405 |
| 4,358,057 | 11/1982 | Burke | 239/333 |
| 4,989,790 | 2/1991 | Martin et al. | 239/483 |
| 5,209,407 | 5/1993 | Farrington | 38/77.5 X |

FOREIGN PATENT DOCUMENTS

| | | | |
|---|---|---|---|
| 2635084 | 2/1990 | France | 239/570 |

*Primary Examiner*—Ismael Izaguirre
*Attorney, Agent, or Firm*—Barry E. Deutsch

[57] ABSTRACT

A spray nozzle for an electric iron includes a nozzle cap having an outlet orifice formed in a first end wall thereof. The cap includes an axially extending cylindrical wall defining an axially extending bore. A fluid flow coupling is inserted into a second end wall of the cap and includes a valve seat. A movable valve member is disposed within the bore and is operable to direct fluid through the outlet orifice when fluid flows through the bore towards the outlet. The valve member moves within the bore into engagement with the valve seat when flow of fluid through the bore is terminated.

1 Claim, 15 Drawing Sheets

10
11
40
59
57
58B
56
44
42
47
46
62
60
48
52
50
12
70
51
58
58A
55
54
45
36
38
49
16
39
30
32
33
41
18
28
17
15
34
27
23
22
25
18
14
20
17
26

SPRAY NOZZLE ASSEMBLY FOR AN ELECTRIC IRON

BACKGROUND OF THE INVENTION

This invention relates to electric irons and in particular to a nozzle assembly for spraying water onto the garments being ironed while the iron is being used.

In the field of electric irons of the type that are commonly used in the modern household, many of the irons include means to emit a spray of water droplets onto the object to be ironed which is positioned in the path of movement of the iron. This spray function is used when ironing certain fabrics and the spray function is controlled by the user of the iron. The spray of water tends to relax the fabric being ironed and assists in removing wrinkles from the garment.

Prior spray nozzle assemblies typically have used either a nozzle having an integral check valve or a separate check valve generally located adjacent to the spray pump. In both instances, the check valve comprises a valve seat sealed by a spring loaded ball which is displaced to allow water flow from the pump through the spray nozzle. The spring returns the ball to the seated position to prevent reverse flow when the user discontinues the spray function.

Assembly of the spray nozzles can be made complicated due to the check valve including the spring loaded ball. The spring and ball are generally small parts and are somewhat difficult to assemble.

As shown in U.S. Pat. No. 5,209,407, some nozzle assemblies contain a plurality of raised pads to create circular water flow through the orifice. The fluid is directed through the raised pads by a substantially flat disc-like member. The present nozzle assembly provides an improvement over the assembly disclosed in the cited United States patent.

It is therefore an object of this invention to provide an electric iron having a spray nozzle which eliminates the separate spring loaded check valve and results in a three piece nozzle assembly which is relatively easy to assemble during manufacture of the iron.

SUMMARY OF THE INVENTION

The foregoing object and other objects of the invention are obtained in a spray nozzle for an electric iron including a nozzle cap having an outlet orifice formed in a first end wall thereof. The cap includes an axially extending cylindrical wall defining an axially extending bore. A fluid flow coupling is inserted into a second end wall of the cap and includes a valve seat. A movable valve member is disposed within the bore and operates to direct fluid through said outlet orifice when fluid flows through said bore towards said outlet. The valve member moves within the bore into engagement with the valve seat when the flow of fluid through the bore is discontinued.

DESCRIPTION OF THE PREFERRED EMBODIMENT

Figure 1:
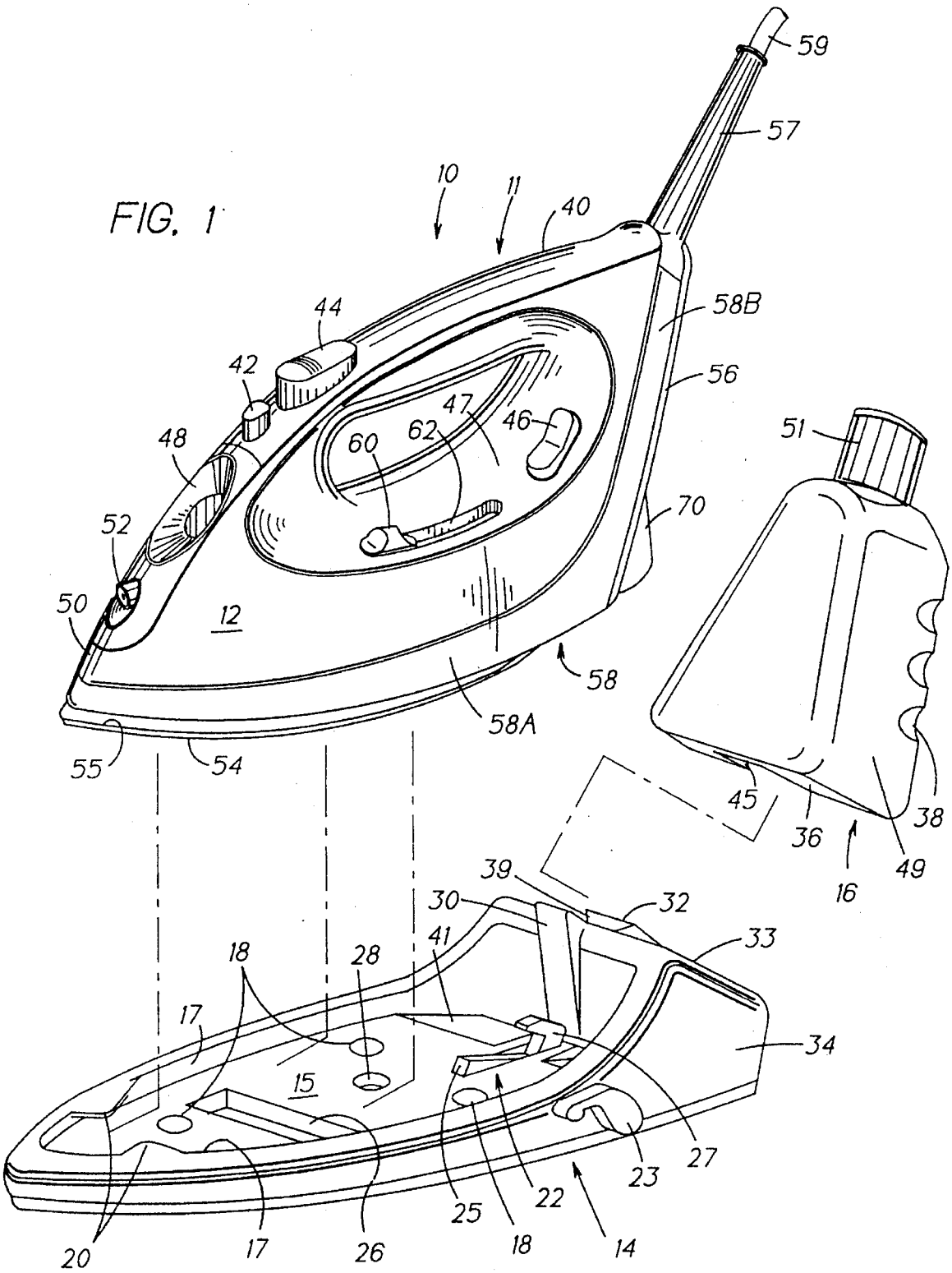
FIG. 1 is an exploded perspective view illustrating the iron, the water cassette, and the base for the iron and cassette.

Referring now to the various figures of the drawing, a preferred embodiment of the present invention shall now be described in detail. In referring to the various figures of the drawing, like numerals shall refer to like parts.

Referring specifically to FIGS. 1, 1A, 2 and 3, there is shown an iron assembly 10 embodying the present invention. Iron assembly 10 includes an iron 11, a water cassette 16, and a base 14. Base 14 includes a generally planar platform member 15 terminating in a downwardly inclined portion 41 at its rear end. Base 14 includes an upwardly extending rim 17. Platform 15 includes three standoffs 18 formed from nonabrasive material such as rubber or the like. Standoffs 18 contact the bottom surface of soleplate 54 of the iron when the iron is placed on the base. As standoffs 18 are made from nonabrasive material, the standoffs will not scratch the surface of the soleplate. Further, the standoffs are made from high temperature resistant material so that the iron may be placed directly in base 14 immediately after ironing is discontinued.

Base 14 includes a pair of inwardly extending hook-like projections 20 formed at the top of rim 17 and located at the front of platform 15. Hook-like projections 20 extend into a groove 55 formed between the top of soleplate 54 and the bottom of skirt 58 of the iron when iron 11 is placed on the base. A rectangular slot 26 and a generally circular opening 28 are formed in platform 15 to enable base 14 to be placed on a mounting bracket for enabling iron assembly 10 to be stored on a wall or similar surface when iron 11 is not in use.

Figure 2:
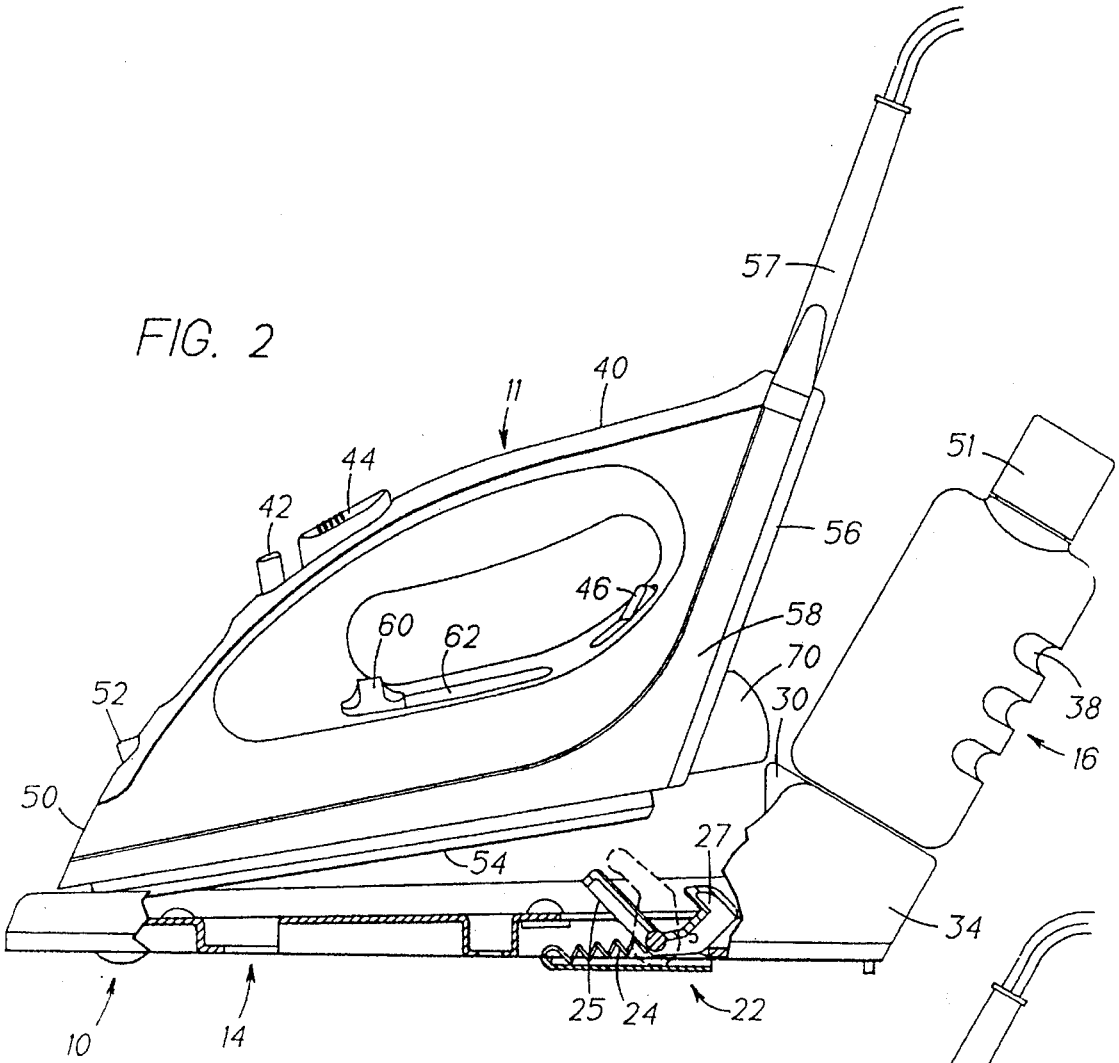
FIG. 2 is a side elevational view, partially in section, of the iron being placed on the base.
Figure 3:
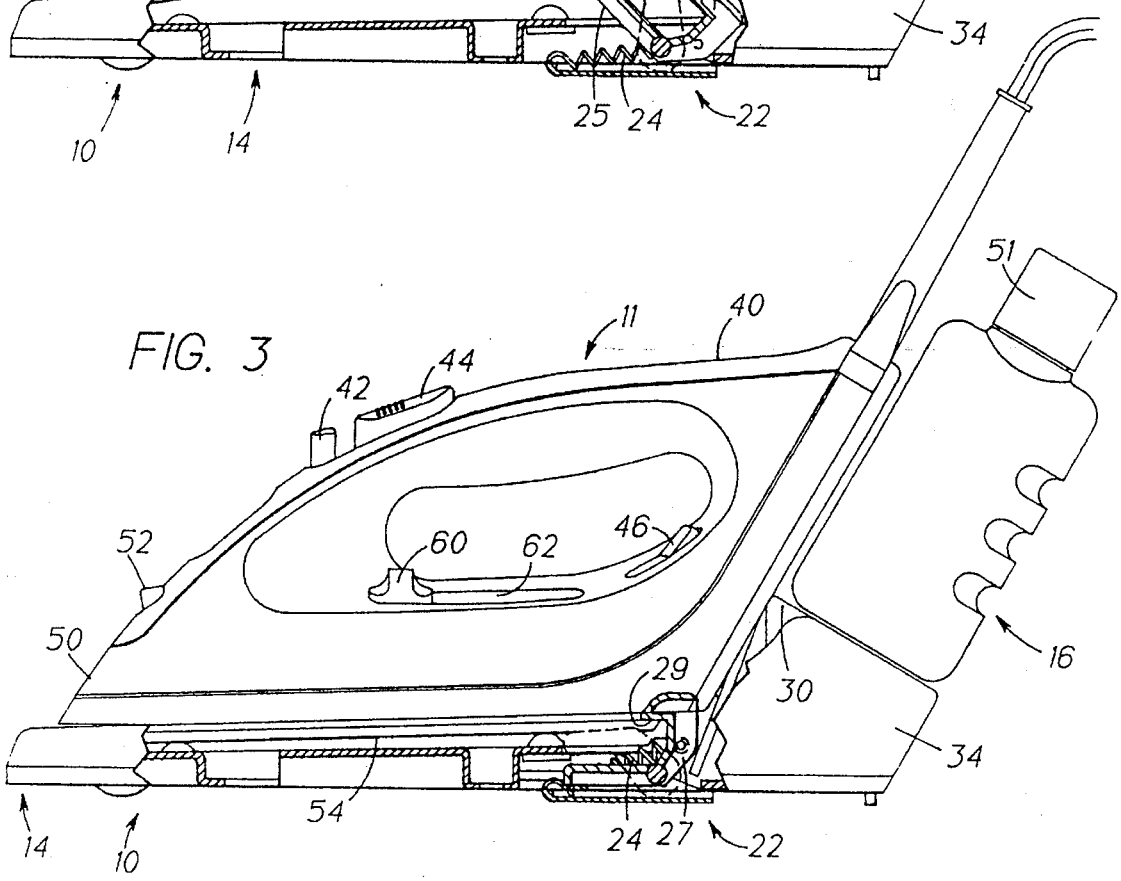
FIG. 3 is a view similar to FIG. 2 with the iron on the base.

Base 14 further includes a pivotal latch 22 having a hook-like portion 27 at one end and an elongated finger 25 extending from hook-like portion 27. The latch is preferably L or reverse J shaped. A handle 23 is connected to latch 22 to pivot the latch between locking and unlocking positions. As shown in FIGS. 2 and 3, latch 22 further includes a spring 24 which keeps the latch in its iron engaged position when the iron is placed on base 14. As illustrated in FIG. 3, a somewhat rectangular slot 29 is formed at the rear face of the iron between soleplate 54 and skirt 58. Hook-like portion 27 projects within slot 29 to retain iron 11 on base 14.

When the iron is not located on the base, for example when the iron is being used, finger 25 extends upwardly above the surface of platform 15. As iron 11 is moved towards the base, as shown in FIG. 2, finger 25 extends into the path of movement of the iron. When the iron is placed on the base, the rear portion of soleplate 54 contacts finger 25. The force developed by soleplate 54 engaging finger 25 rotates latch 22 counterclockwise into its locking position. When the user desires to remove iron 11 from base 14, the user rotates handle 23 clockwise to pivot latch 22 clockwise to release the iron. Even if engaging finger 25 is moved below the plane of platform 15 when the iron is not in the base, when the front of the iron is placed in the base so that projections 20 are inserted into groove 55, the rear face of skirt 58 will contact portion 27 and rotate the latch clockwise until finger 25 contacts 54 of iron 11. Further movement of the iron into the base will result in the latch pivoting counterclockwise into its locking position.

Figure 1A:
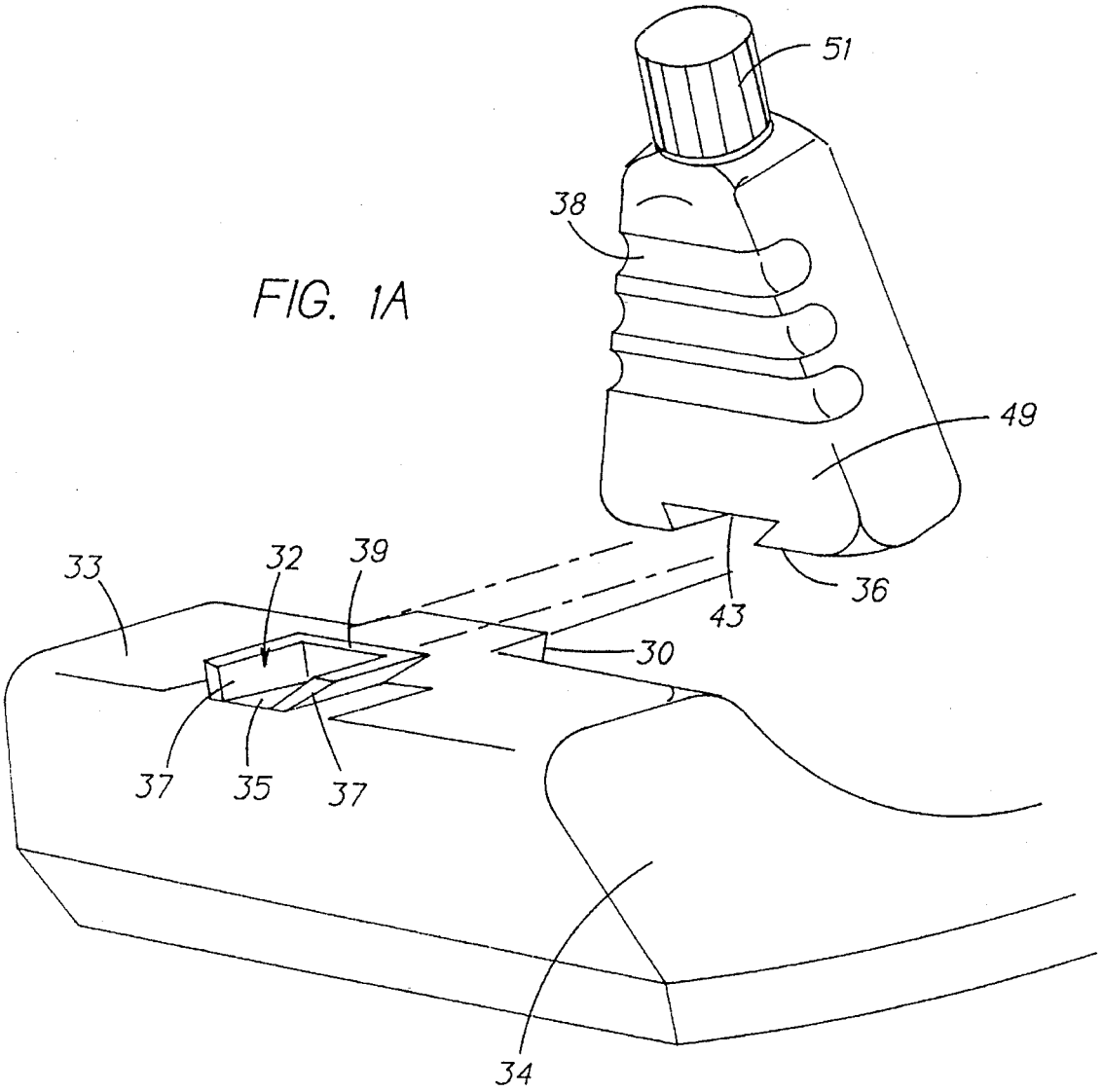
FIG. 1A is an exploded perspective view of the cassette and portion of the base illustrating further details thereof.

As shown in FIGS. 1 and 1A, base 14 includes a rear section 34 defining the rear wall of the base. Rear section 34 includes a vertically extending inwardly projecting abutment member 30 and a tail portion 32 extending upwardly from the top face 33 of rear section 34. Tail portion 32 comprises a generally horizontal extending floor member 35, a pair of inwardly inclined sidewalls 37 and an inwardly inclined front wall 39. The rear of tail section 32 is open.

Water cassette 16 includes a bottom wall 36 having a generally rectangularly shaped slot 43 formed therein. Slot 43 is configured to complement the shape of tail portion 32 so that the tail portion may be slid within the slot to join the cassette to the base. Slot 43 terminates in a vertical wall 45 which mates with vertical wall 39 of tail portion 32 when the tail portion is inserted into the slot. Cassette 16 further includes a plurality of horizontally extending ribs 38 to give rigidity to the wall 49 of cassette 16. The ribs also function as a cordwrap for power cord 59 when the iron is stored. A cap 51 is threadably received on the spout (not shown) of the cassette.

Housing 12 includes a nose portion 50. Housing 12 is attached to skirt 58 which, in turn, is attached to soleplate 54. Groove 55 is formed between the top surface of soleplate 54 and the bottom surface of skirt 58. Groove 55 enables the user to readily iron garments having buttons and also functions to receive projections 20 as previously described. Skirt 58 is generally L-shaped and comprises a horizontal leg 58A and a substantially vertical leg 58B.

Spray nozzle 52 extends forwardly of nose portion 50 of housing 12. Nose portion 50 further includes fill opening 48. Housing 12 further includes handle 40. Steam control valve 42 extends upwardly from handle 40. Handle 40 further includes spray pump control 44. Control 44 activates pump 44A (See FIG. 17).

An on/off switch 46 is positioned on the saddle portion 47 of housing 12. An arcuate opening 62 is formed in saddle portion 47. The arcuate opening forms a track for thermostat control knob 60. Arcuate opening 62 is inclined downwardly about 2° from its rear to its forward faces. The inclination of the track follows the general contour of saddle portion 47.

A rear cover 56 is attached to the outer surface of vertical leg 58B of skirt 58. An opening is formed between the outer surface of leg 58B and the opposed surface of cover 56. A cord bushing 57 extends outwardly through the opening. Cord bushing 57 surrounds power cord 59. Power cord 59 is connected to a source of electrical power for delivering electrical power to the iron for actuating among other components the electrical resistance heater (shown in FIG. 18) associated with the soleplate in heat transfer relation as is conventional in the art. A rotatable foot-like member 70 is attached to cover 56 for a reason to be more fully explained hereinafter.

Referring now in detail to FIGS. 4–9, the function of foot member 70 in conjunction with the steam control, on/off switch, and base shall be more fully explained.

Figure 4:
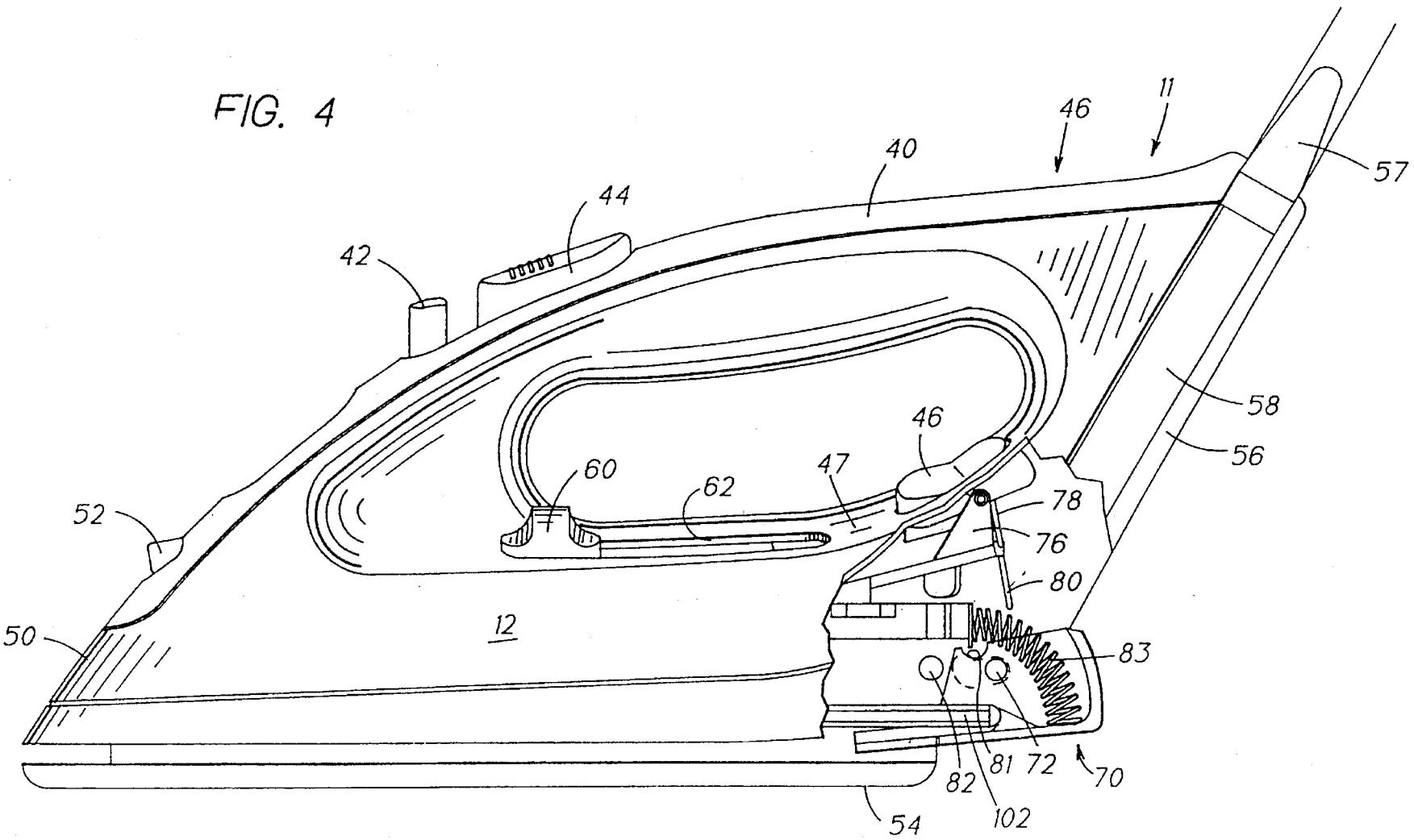
FIG. 4 is a side elevational view of the iron, with parts broken away for clarity, illustrating the iron on the soleplate thereof.

As illustrated, foot member 70 is pivotally connected to cover 56 at pivot 72. As shown in FIG. 4, when the soleplate is placed in a horizontal plane and the iron is supported on an underlying garment or the surface of the ironing board, foot member 70 lies generally parallel to the soleplate and is spaced above the underlying support surface. An actuator arm 102 of steam control assembly 100 extends within the pivotal path of movement of foot member 70. When the iron is positioned as shown in FIG. 4, actuator arm 102 is urged towards cover 56.

Figure 6:
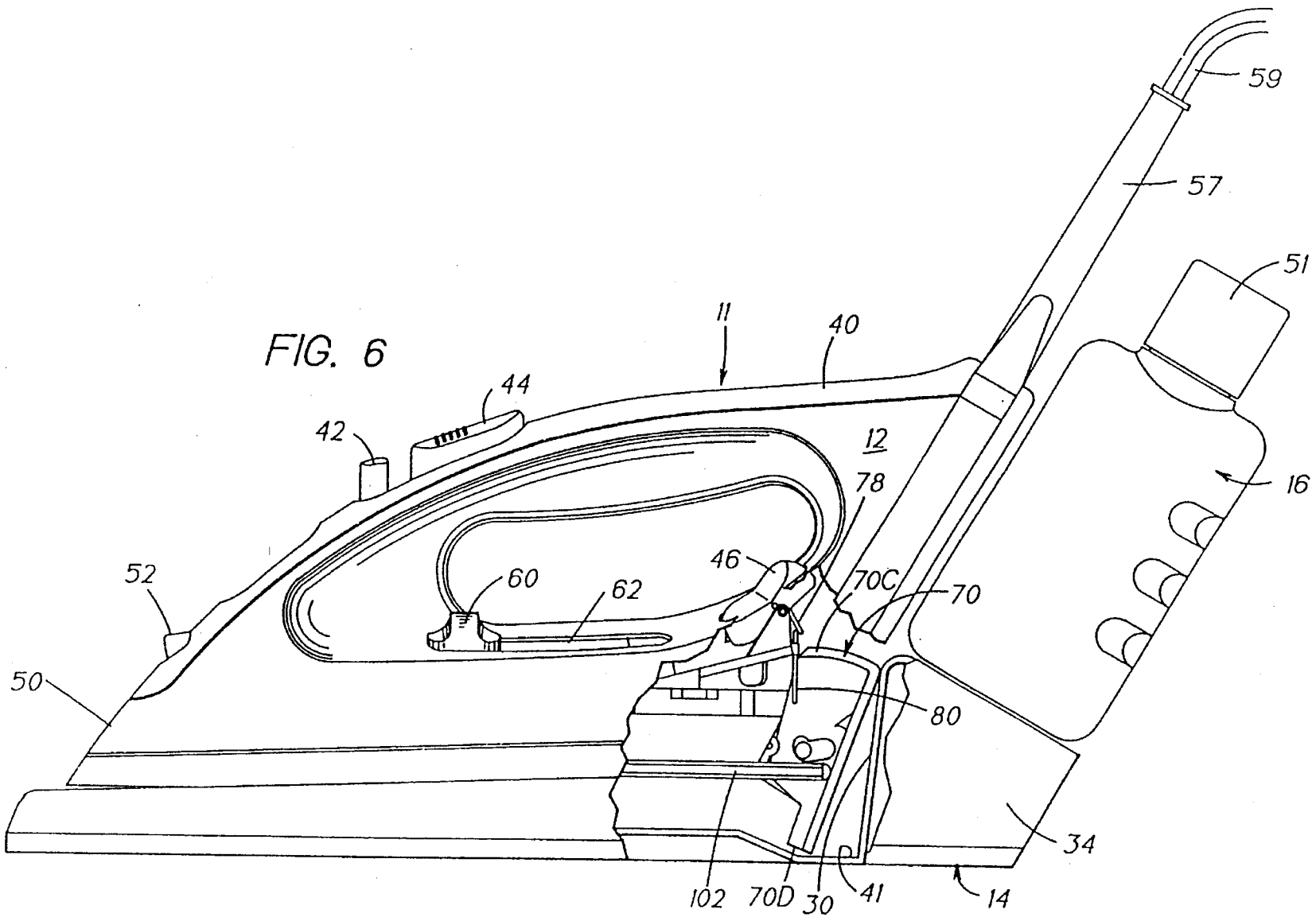
FIG. 6 is a view similar to FIGS. 4 and with the iron in the base.

Further as illustrated in FIG. 4, on/off switch 46 is in its on position connecting iron 11 to the source of electrical power. On/off switch 46 is pivotally connected to skirt 58 via bracket 76. On/off switch 46 includes a trigger member 78. Rotatable actuator 80 is positioned in the path of movement of foot member 70 when the iron is placed on base 14 as illustrated in FIG. 6. Movement of actuator 80 results in contact between the actuator and trigger member 78.

Figure 5:
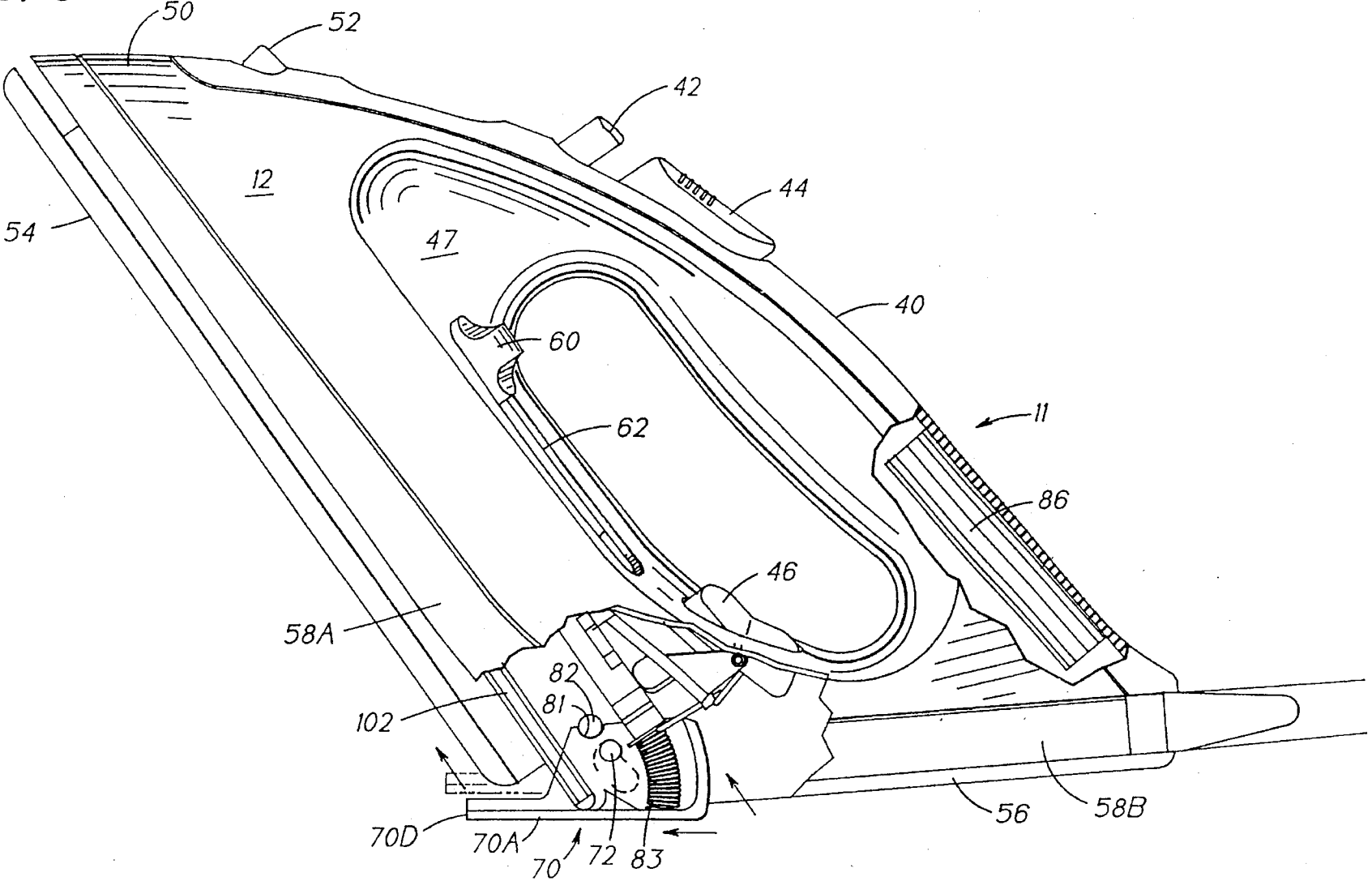
FIG. 5 is a view similar to FIG. 4 with the iron on its heel rest.

FIG. 5 illustrates the iron supported on its heel rest. The rear surface of cover 56 defines the heel rest for the iron. As the iron is rotated from its horizontal position to its heelrest position, the weight of the iron provides a force to rotate foot member 70 in a counterclockwise direction to achieve the position illustrated in FIG. 5. The weight of the iron also provides a force which causes the foot member to translate parallel to the soleplate in the direction of the arrow shown in FIG. 5. When so translated in the direction shown, notch 81 of the foot member engages a complementary surface 82 on the cover to latch the foot member in the position illustrated. Spring 83 is compressed as a consequence of the rotational movement of foot member 70.

When foot member 70 has been rotated to the position illustrated in FIG. 5, the foot member extends the effective length of the heel rest. It should be noted that iron 11 has a rather unique shape. Particularly, it should be noted that the upwardly extending leg 58B of skirt 58 is at an obtuse angle relative to horizontal leg 58A of the skirt. Typically, the upwardly extending leg of a skirt is perpendicular or at an acute angle to the horizontally extending leg of the skirt. Thus, the cover of the iron attached to the upwardly extending leg readily provides a suitable support for the iron when the iron is placed in the heel rest position. Due to the rather unique shape of the present iron 11, and in the absence of foot member 70, the weight of the iron will cause the iron to rotate in a counterclockwise direction if the iron were placed on cover 56. Foot member 70 when extended in the position shown in FIG. 5, increases the length of cover 56 so that the fulcrum or pivot point for the iron is shifted to the left (towards the soleplate) as viewed in FIG. 5 so that the clockwise moment arm tending to maintain the iron on its heel rest increases in magnitude and the counterclockwise moment arm decreases in magnitude. A relatively light weight 86 may be added to the handle to increase the magnitude of the clockwise moment arm to further insure the stability of the iron when the iron is placed on its heel rest. Since the fulcrum has been moved as a consequence of the extension of foot member 70, weight 86 may be relatively light so as not to unduly increase the total weight of the iron.

As illustrated in FIG. 5, the rotational movement of foot member 70 results in leg 70A thereof contacting actuator arm 102 of steam valve assembly 100. The force provided by leg 70A moving into contact with actuator arm 102 of steam valve 100 moves the actuator to the left as viewed in FIG. 4 or upwardly as viewed in FIG. 5. As shall be more fully explained hereinafter, this movement of the actuator arm results in the stoppage of flow of water from water reservoir 120 into steam chamber 122.

When iron 11 is moved from the heel rest position illustrated in FIG. 5 to the ironing position illustrated in FIG. 4, notch 81 disengages from surface 82, enabling foot member 70 to rotate in a clockwise direction as viewed in FIG. 4. Spring 83 provides the force to rotate foot member 70 from its heel rest position (FIG. 5) to the ironing position (FIG. 4). If the foot member is jammed into its heel rest position when the iron is returned to its ironing position, the lower edge 70D of foot member 70 extends below the bottom surface of soleplate 54. Edge 70D contacts the underlying support surface (ironing board or garment) and the force of such engagement triggers the foot member to translate in the direction opposite to the arrow illustrated in FIG. 5. This movement releases notch 81 from surface 82.

Referring now to FIG. 6, iron 11 is shown mounted on base 14. When the iron is placed on its base, abutment member 30 of rear section 34 of the base engages foot member 70 to rotate foot member 70 in a counterclockwise direction. As noted previously, the foot member is rotated in a counterclockwise direction when the iron is placed on its heel rest; however the shape of abutment member 30 causes the foot member to have a larger arc of rotation when the iron is placed on base 14 than when the iron is placed on its heel rest.

Foot member 70 is rotated counterclockwise when iron 11 is placed on the base, to move actuator arm 102 of steam valve assembly 100 to the left as shown in FIG. 6. Further, upper face 70C of the foot member engages actuator 80 associated with on/off switch 46. The actuator in turn engages trigger member 78 of the switch to rotate the switch in a counterclockwise direction from its on position to its off position. Thus, when iron 11 is placed on base 14, engagement of foot member 70 with abutment member 30 results in the foot member moving the actuator arm 102 to discontinue flow of water into steam chamber 122 and also results in the electrical power to the iron being interrupted since the on/off switch is moved into its off position. Inclined portion 41 of platform member 15 enables foot member to rotate to the position shown in FIG. 6 when the iron is placed on base 14. Inclined portion 41 accepts the extended portion of foot member 70 terminating in edge 70D.

Figure 7:
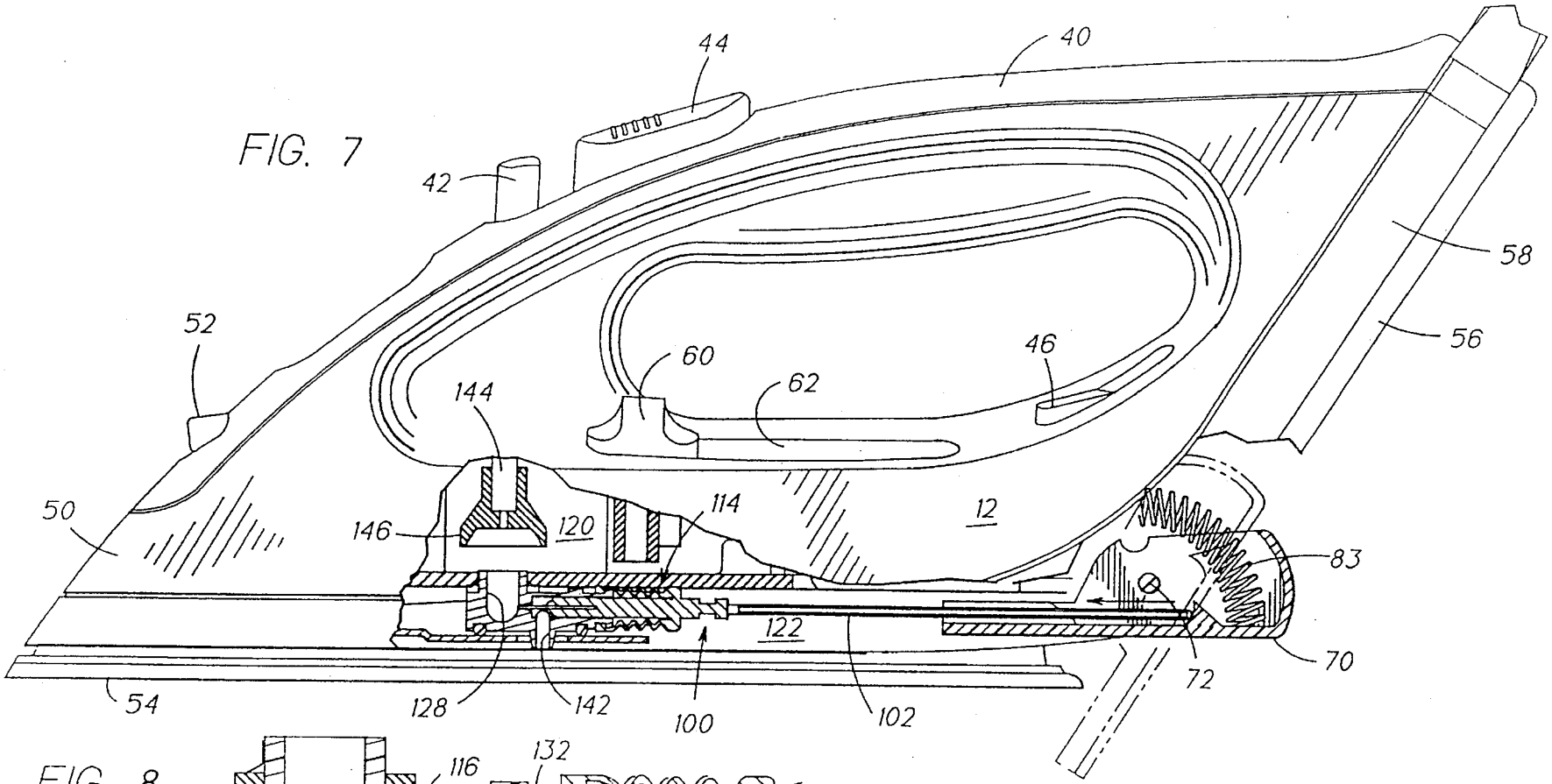
FIG. 7 is a side elevational view of the iron, partially in section, with the iron on the soleplate.
Figure 8:
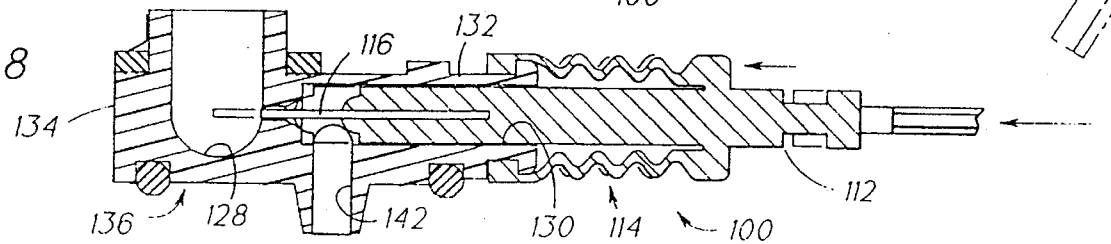
FIG. 8 is an enlarged sectional view of the steam control assembly employed in the iron.
Figure 9:
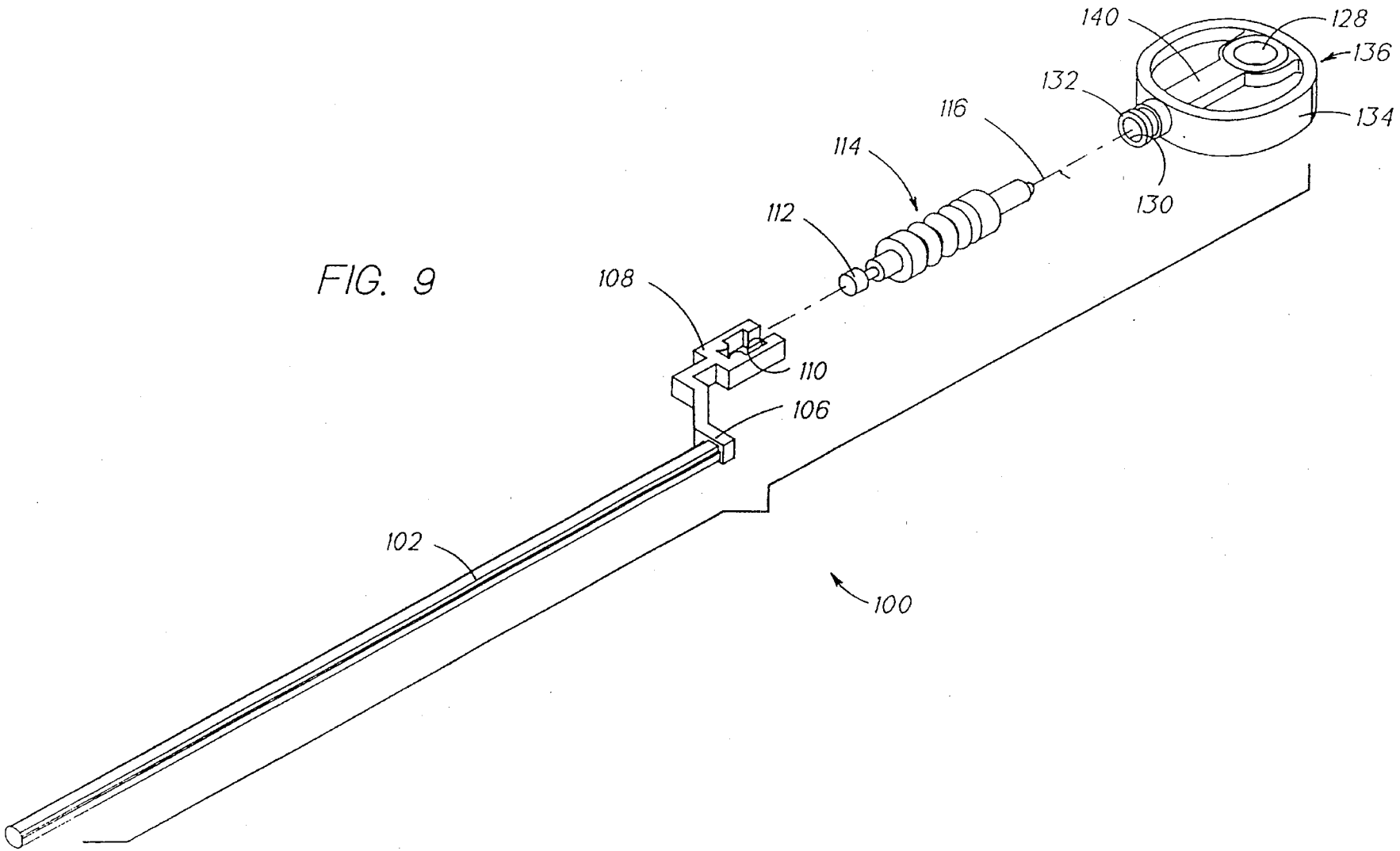
FIG. 9 is an exploded perspective view of the steam control assembly.

Referring now to FIGS. 7, 8, 9, and 18, steam control assembly 100 shall now be described in detail. Steam control assembly 100 is mounted in a track 124 formed in the top surface 126 of skirt 58 and includes a longitudinally extending actuator arm 102 which, has one end as previously described extending into the path of travel of foot member 70. As shown in FIG. 9, actuator arm 102 is connected to a rib 106 which in turn is connected to an actuator fork 108 having a U-shaped slot 110 formed therein. One end 112 of a spring bellows 114 extends within slot 110.

The other end of spring bellows 114 terminates in a longitudinally extending pin 116. As shown in FIGS. 7 and 8, the pin and associated end of the spring bellows extend into an orifice 130 of conduit 132. Conduit 132 extends outwardly from the sidewall 134 of valve housing 136. Valve housing 136 includes a chamber 128. Passageway 140 communicates orifice 130 with chamber 128. Passageway 140 also communicates chamber 128 with outlet 142. Pin 116 extends through the passageway into the chamber to clean the passageway and meter the flow of water from the chamber into the passageway. End 112 of bellows 114 closes the passageway when the bellows is moved to the left as viewed in FIG. 8 and interrupts flow between chamber 128 and outlet 142. Actuator arm 102 moves bellows 114 to terminate the flow of water from water reservoir 120 into steam chamber 122.

Housing 14 includes steam control valve 42 for enabling the user to operate iron 11 in either dry or steam modes. FIG. 7 illustrates control valve 42 when the iron is being operated in its steam mode. Steam control valve 42 is connected via valve stem 144 to valve 146. As shown, when valve 146 is spaced above chamber 128, water will flow from water reservoir 120 into valve chamber 128 and thence into outlet 142 and steam chamber 122. When in the position shown, iron 11 may be used to steam and iron a garment. If dry ironing is desired, control valve 42 is moved downwardly to move valve stem 144 and attached valve 146 downwardly to close off the flow of water from reservoir 120 into chamber 122.

When the iron is rotated into its heel rest position, foot member 70 is rotated in a counterclockwise direction which, in turn, moves actuator arm 102 to the left as viewed in FIGS. 7 and 8. Movement of the actuator arm in this manner results in end 112 of bellows 114 closing the orifice to discontinue the flow of water from the water reservoir through chamber 128 and then into outlet 142. The same movement of the foot member and actuator arm occurs when the iron is placed in the base and the foot member engages abutment member 30.

Figure 10:
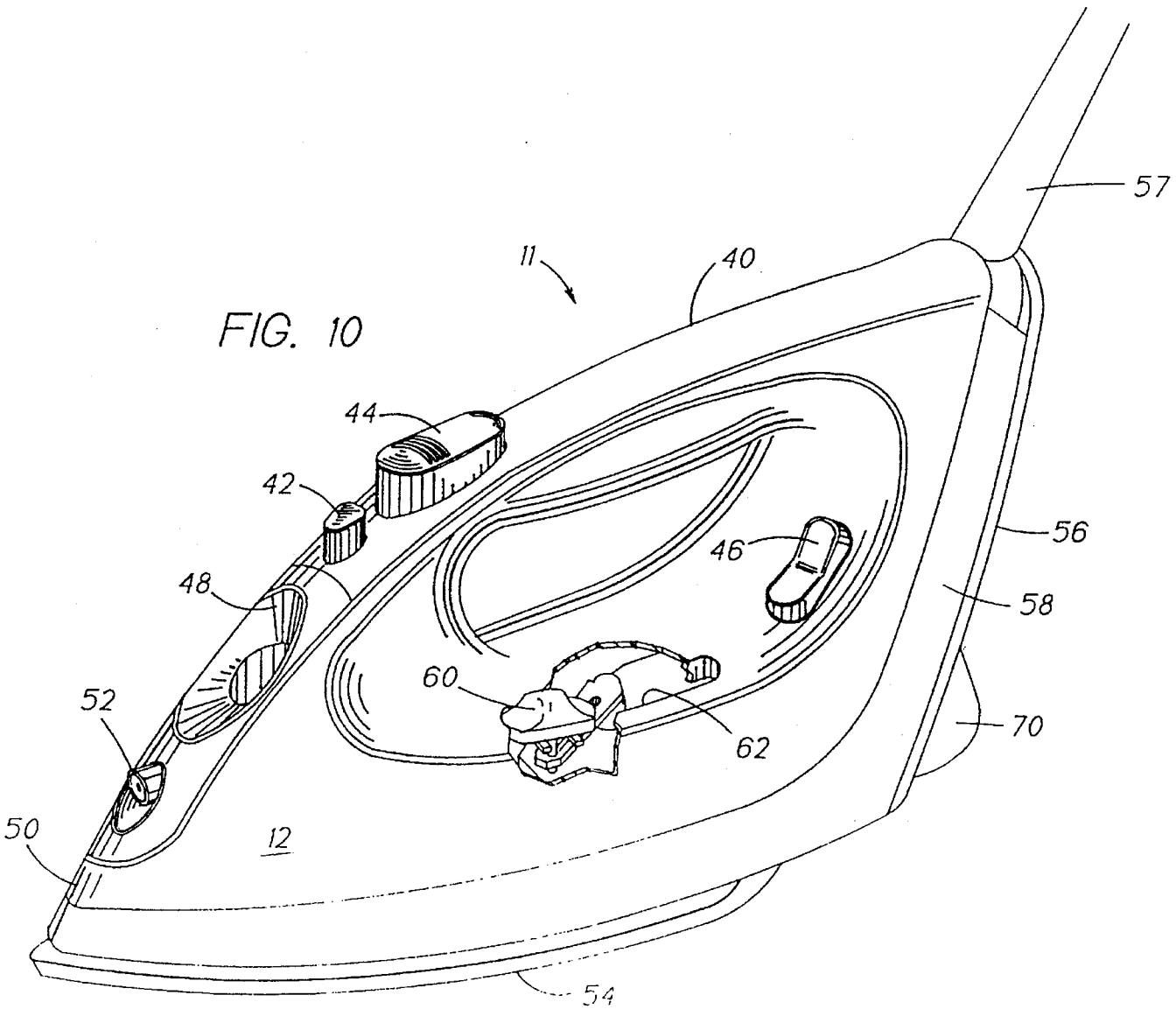
FIG. 10 is a side elevational view with parts broken away to illustrate a thermostat control used in the iron.
Figure 11:
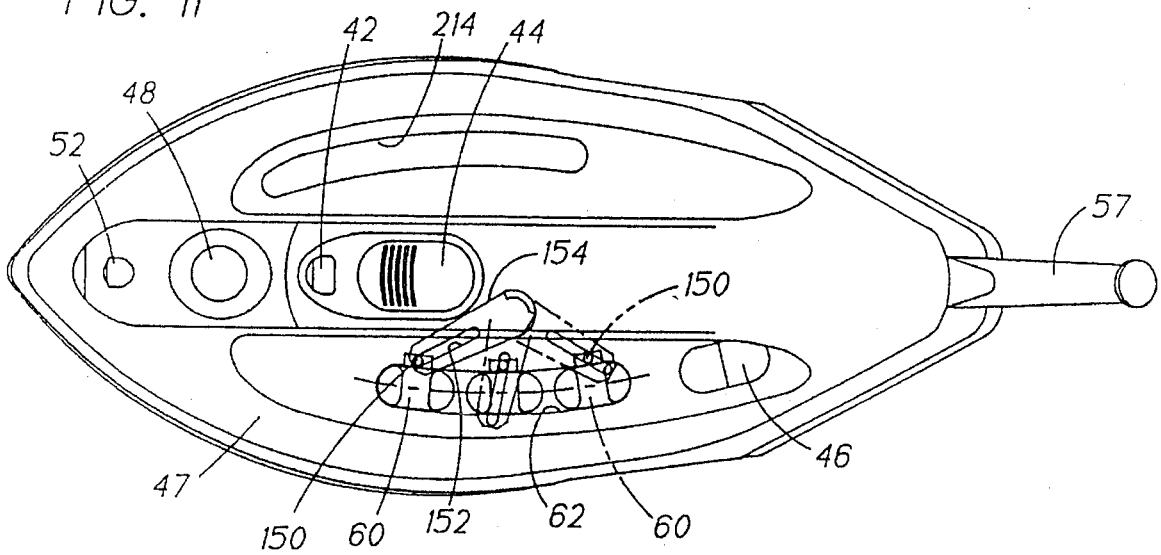
FIG. 11 is a top plan view of the iron further illustrating the thermostat control.
Figure 12:
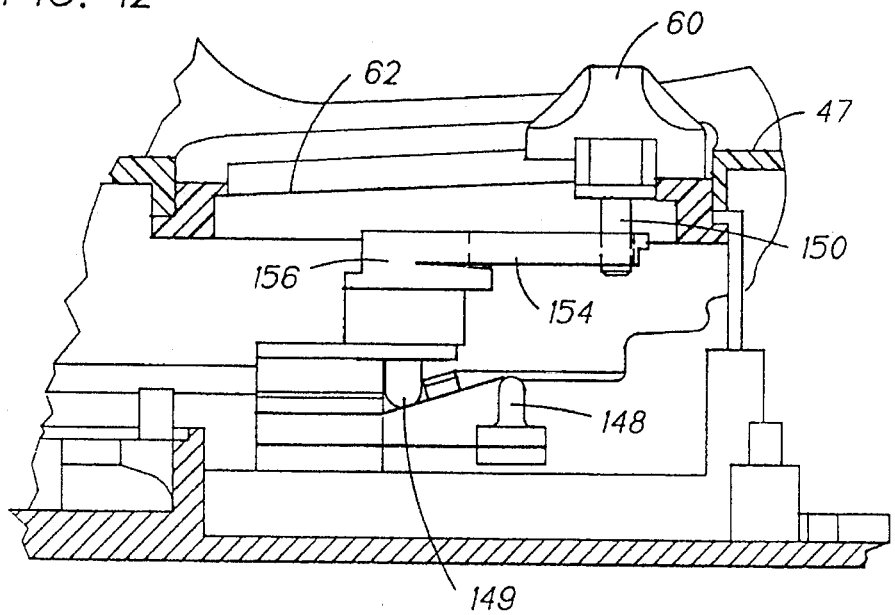
FIG. 12 is an enlarged sectional view of a portion of the iron illustrating the thermostat control.

Referring now to FIGS. 10–12, there is disclosed a preferred embodiment of the thermostat control for iron 11. As noted previously, saddle 47 of the iron includes an arcuate track 62 in which control knob 60 is movably mounted. Track 62 extends arcuately in a horizontal plane through the saddle portion and, as shown in FIG. 12 has a vertical slope so that track 62 is angled downwardly from the rear end of iron 11 towards nose portion 50 thereof. The slope of the track is substantially 2° and the arcuate travel of knob 60 in track 62 is substantially 10°.

As shown in FIG. 12, control knob 60 is connected to a vertically extending pin 150. The vertical axis of pin 150 is offset inwardly towards the center of iron 11 with respect to a vertical plane passing through the center of knob 60. Pin 150 extends within horizontally extending slot 152 of actuator lever 154. Lever 154 is integrally formed with rotatable actuator 156. Actuator 156 is attached to upwardly extending shaft 149 of thermostat 148. Thermostat 148 senses the temperature of soleplate 54. Pin 150 and actuator lever 154 comprise a linkage connecting control knob 60 to actuator 156, which in turn controls the operation of thermostat 148. The length of the radius establishing arcuate track 62 is substantially larger when compared to the length of the radius establishing the rotational path of movement of actuator 156. Movement of control knob 60 through a 10° arcuate path of travel results in substantially a 120° rotational movement of actuator 156 and shaft 149 of thermostat 148.

As shown in FIG. 11, as control knob 60 is arcuately moved along track 62, pin 150 transfers the force developed by movement of the knob to the actuator lever 154 and then to actuator 156 for establishing a set or operating point for thermostat 148. As the arcuate path for travel of knob 60 is substantially less than the arcuate path of travel of actuator 156, the distance between pin 150 and the center of rotation of actuator 156 is constantly changing. Further, the vertical position of the pin relative to slot 152 changes during movement of knob 60 due to the inclination of track 62. Pin 150 slides within slot 152 of lever 154 as a consequence of the movement of the control knob. In effect, the slot compensates for the vertical movement of pin 150 relative to lever 154 and also enables the distance between pin 150 and the center of rotation of actuator 156 to change. The described control enables thermostat control knob 60 to be mounted on a saddle having a rather complex geometrical shape.

Figure 13:
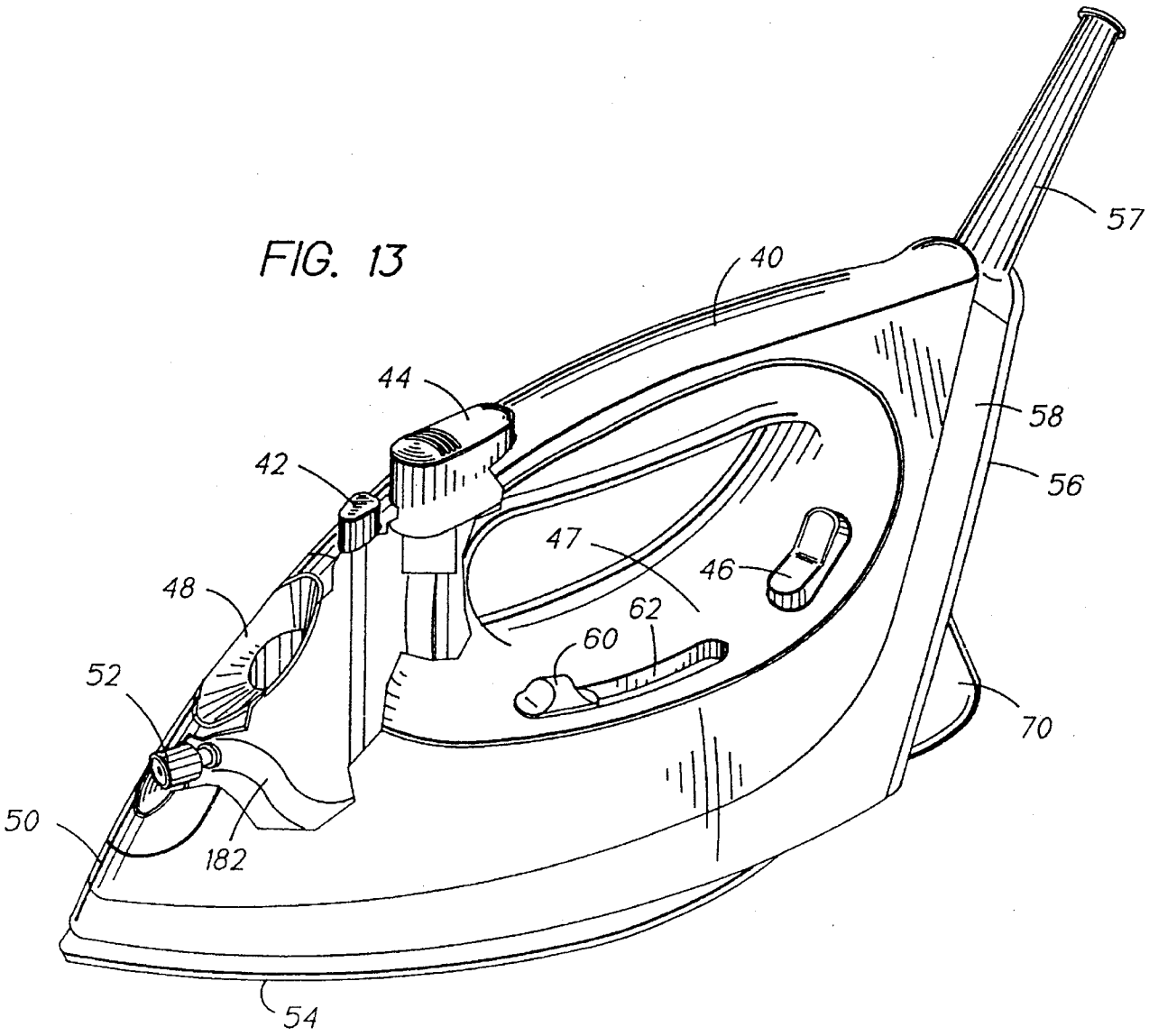
FIG. 13 is a side perspective view of the iron with parts broken away to illustrate a spray nozzle assembly employed on the iron.
Figure 14:
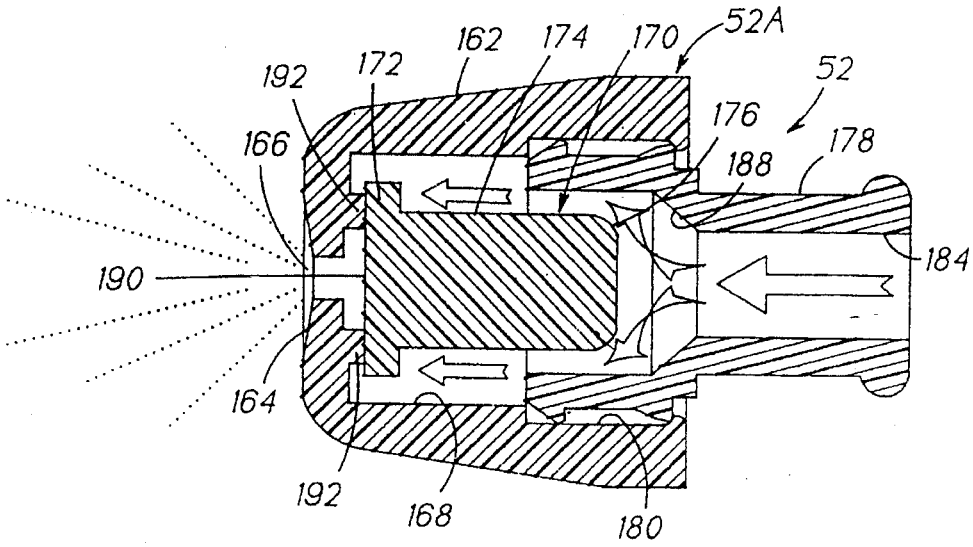
FIG. 14 is an enlarged perspective view of the spray nozzle assembly.
Figure 15:
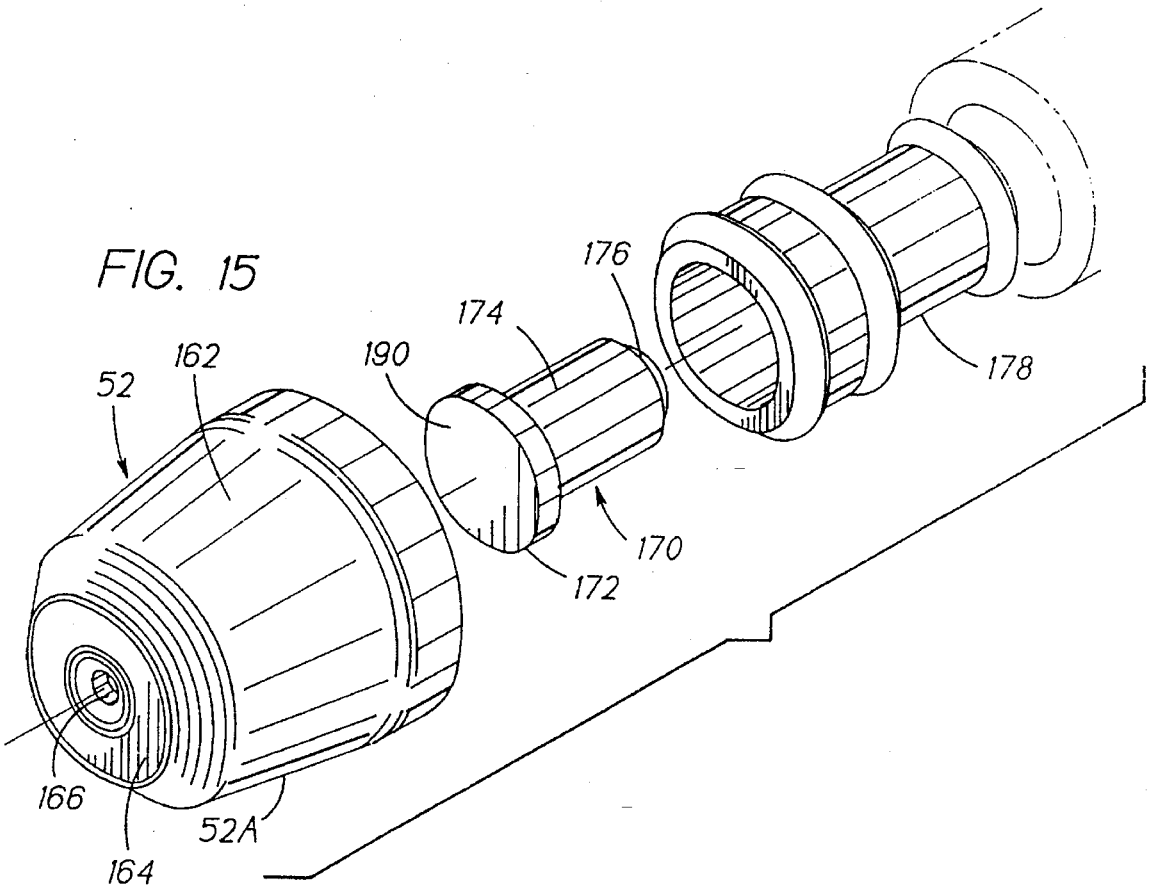
FIG. 15 is an enlarged perspective view of the nozzle assembly.

Referring now to FIGS. 13–15, there is disclosed a preferred embodiment of the spray nozzle assembly 52 as used in the present iron assembly 10. Spray nozzle assembly 52 is mounted at the nose portion 50 of iron 11. Spray pump control 44 extends upwardly from handle 40 of iron 11. When the user desires to spray an underlying garment, the user presses downwardly on pump control 44 which creates a pumping action to pump water via pump 44A (See FIG. 17) from water reservoir 120 through line 182 and then through nozzle 52A of nozzle assembly 52. Nozzle assembly 52 includes nozzle 52A having a generally frusto-conically shaped outer wall 162 and an end wall 164 having a spray opening 166 generally located at the center thereof. Outer wall 162 defines a longitudinally extending bore 168. A spreader element 170 is disposed within the bore for reciprocating movement therein. Spreader element 170 includes a generally enlarged cylindrical head 172, a longitudinally extending body portion 174 and a spherical spreader end 176. A coupling 178 extends within an open end 180 of nozzle assembly 52. Line 182 is fitted over the outer end of coupling 178 to communicate bore 184 with water reservoir 120. Coupling 178 includes a valve seat 188 facing towards spherical end 176 of spreader element 170.

In operation, when the user desires to spray a garment being ironed, the user pumps control 44 to pump water from water reservoir 120 via pump 44A through line 182, thence into bore 168. The force of the water moves the spreader to the left as viewed in FIG. 14 so that surface 190 of the spreader contacts the inwardly extending pads 192 of nozzle assembly 52. Cylindrical head 172 of spreader element 170 directs the water in bore 168 towards the perimeter. Raised pads 192 comprise a plurality of circumferentially spaced members disposed on the interior surface of end wall 164. The water forced to the perimeter of bore 168 flows under the spreader and then radially inwardly between the raised pads to the centrally located orifice 166. The water is then sprayed in a desired pattern onto the garment.

When the user ceases pumping control 44, the return action of pump 44A creates a suction on line 182 moving spreader element 170 to the right as shown in FIG. 14 which results in spherical end 176 engaging seat 188 to create a seal. The seal prevents air from being sucked into the discharge side of pump 44A.

Figure 16:
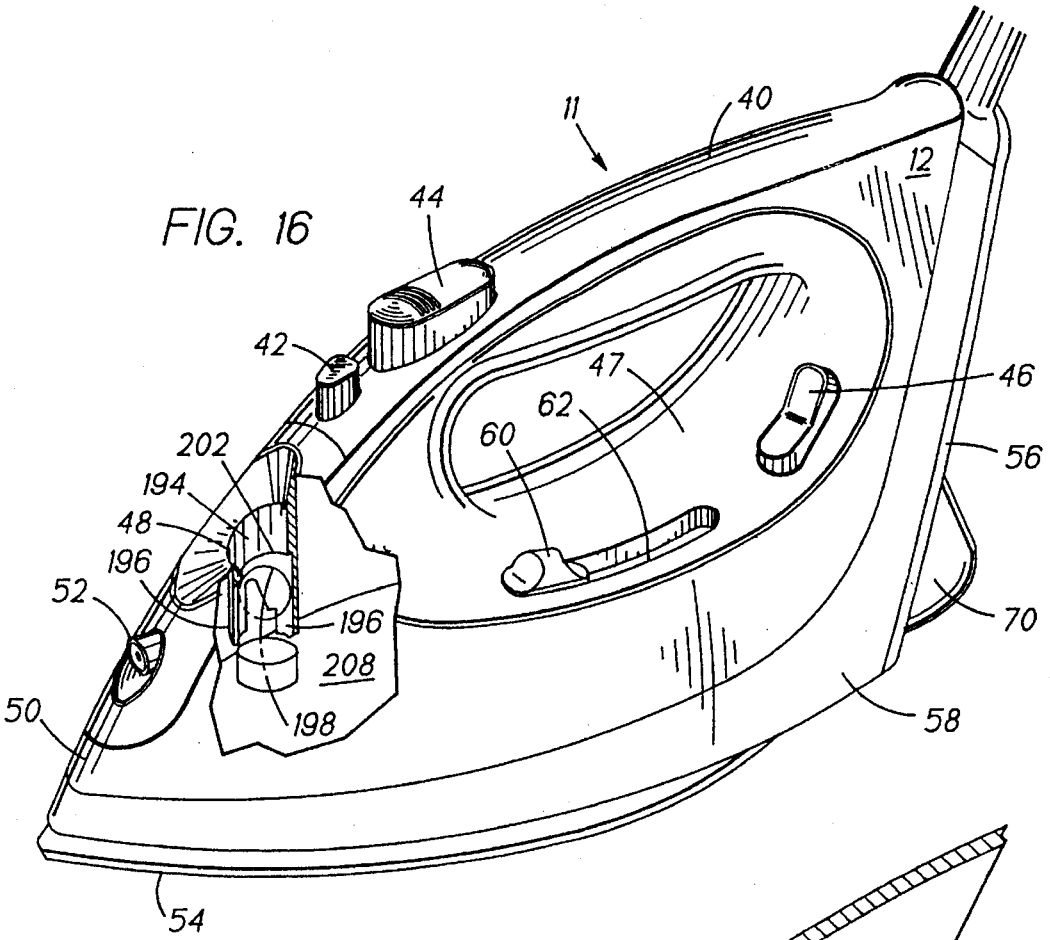
FIG. 16 is a side perspective view of the iron with parts broken away to illustrate a reservoir fill control for the iron.
Figure 17:
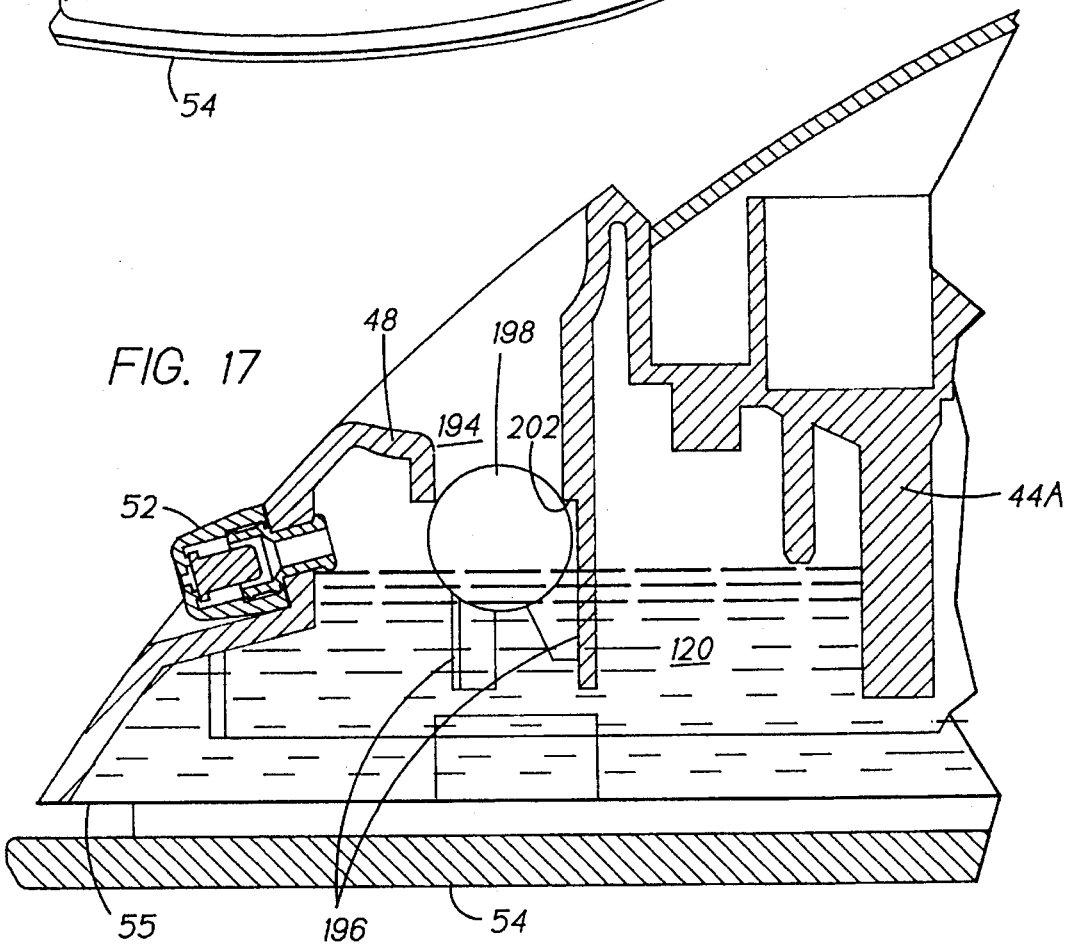
FIG. 17 is a partial sectional view of the iron illustrated in FIG. 16.

Referring now to FIGS. 16 and 17, the details of the fill system for water reservoir 120 shall be described in detail. A somewhat elliptically shaped opening 48 is formed in housing 12 at the nose portion or front end thereof 50. Opening 48 communicates with a water flow passage 194 defined between downwardly extending ribs 196. Ball valve or float valve 198 is disposed within flow passage 194. The specific gravity of ball valve 198 is less than one so that the valve floats on water. Lower wall 208 of reservoir 120 and the ribs entrap the ball valve. When the ball valve is moved upwardly within the passage, the ball valve seats against valve seat 202 to prevent water from splashing outwardly through opening 48.

When the user is filling water reservoir 120, a source of water is placed in communication with flow opening 48. For example, flow opening 48 may be placed beneath a faucet or cassette 16 may be used to add water to reservoir 120. Water fills the water reservoir causing float valve 198 to move upwardly in passage 194. When the iron is in normal use and water is in the reservoir, the float valve again is moved upwardly since its specific gravity is less than one. Valve 198 is forced against seat 202 to prevent the water from splashing outwardly through opening 48 during normal ironing use.

Further, when the iron is placed in a vertical position, for example when it is desired to steam or iron a garment held in a vertical position, if water level in the reservoir is relatively high, the water will cause ball valve 198 to remain seated, preventing water from splashing out when the iron is held upright.

Figure 18:
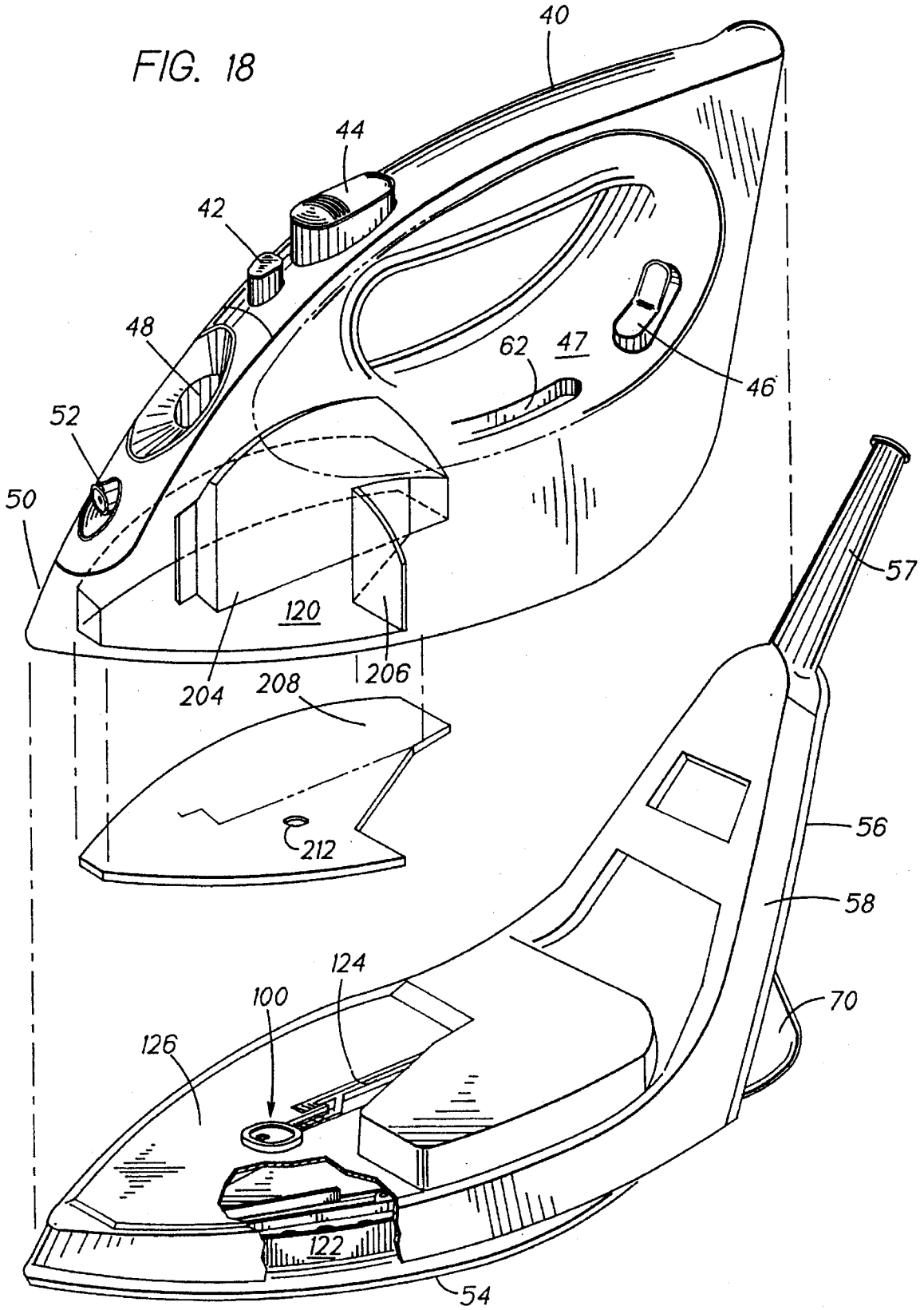
FIG. 18 is an exploded perspective view of the iron and base illustrating details of the water reservoir of the iron.
Figure 19:
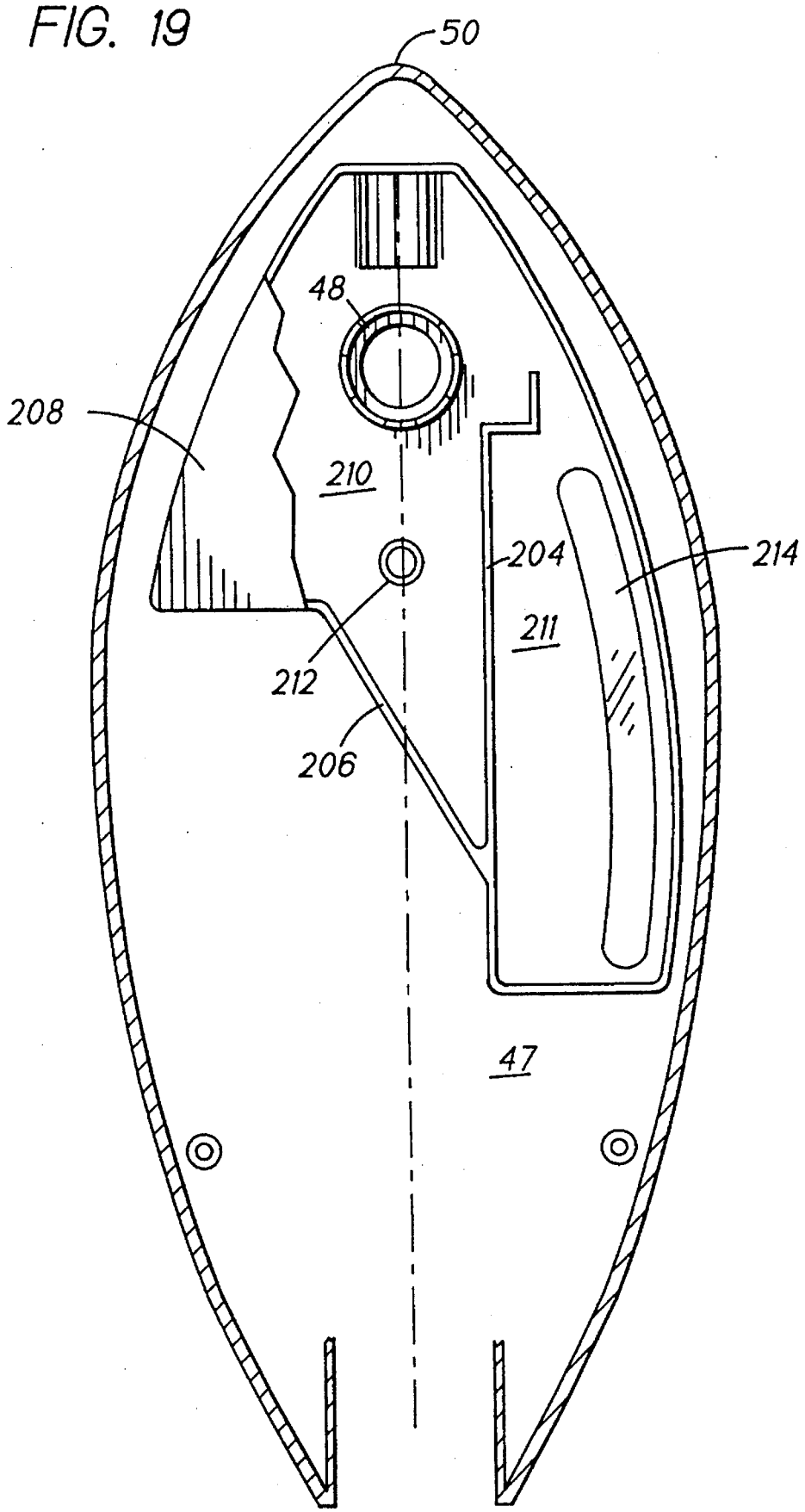
FIG. 19 is a plan view partially in section and partially broken away of the water reservoir.

Referring now to FIGS. 18 and 19, the structure of reservoir 120 shall now be more fully described. Reservoir 120 includes a plurality of walls 204 and 206 which extend upwardly part way from the top of lower or bottom wall 208 of reservoir 120. Walls 204 and 206 serve as dam means or as weir means to separate the reservoir into a forward compartment 210 and a rear compartment 211. It should be noted opening 212 in bottom wall 208 is located at the rear of forward compartment 210. In effect, walls 204 and 206 serve as dam means to provide a head of water above opening 212 when the iron is held in a vertical position. The head of water in forward compartment 210 enables iron 11 to be used as a steamer while the iron is held in a vertical position. By trapping water in the forward compartment when the iron is turned vertical, water will continue to flow from reservoir 120, through opening 212, steam valve chamber 128 and then into steam chamber 122. The iron will generate steam for a period of time until the supply of trapped water in compartment 210 is exhausted.

To replenish the supply of water in forward compartment 210, the user need only tip the iron forward and water in rear compartment 211 will flow into the forward compartment. When the iron is returned to its vertical position, divider walls 204 and 206 will retain the water in the forward compartment.

A water window 214 is disposed on saddle portion 47 and in alignment with rear compartment 211. When the iron is placed on its heel rest or held vertical, the user may look at the water window which, since it is in vertical alignment with the rear compartment provides an accurate indicator of the amount of water remaining in the water reservoir. If there is insufficient water in the reservoir to satisfy the steaming function, additional water can be added to reservoir 120 from cassette 16 or from a sink faucet.

While a preferred embodiment of the present invention has been described and illustrated, the invention should not be limited thereto but may be otherwise embodied within the scope of the following claims.

What is claimed is:

1. An electric iron comprising:

a soleplate;

a housing connected to the soleplate;

a water reservoir formed within the house;

a fluid pump having an inlet in fluid flow communication with the water reservoir and an outlet;

a spray nozzle extending from a front wall of said housing;

fluid delivery means communicating the spray nozzle with the outlet from said pump;

said spray nozzle including a nozzle cap having an outlet orifice formed in a first end wall thereof, said cap including an axially extending cylindrical wall defining an axially extending bore and a plurality of circumferentially spaced pads disposed within said bore for directing fluid from said wall toward said outlet orifice;

a fluid flow coupling inserted into a second end wall of said cap and including a valve seat, said fluid flow coupling being in fluid flow communication with said fluid delivery means; and a movable valve member disposed within said bore and operable to direct fluid through said outlet orifice to direct fluid through said outlet orifice when fluid flows through said valve seat and thence through said bore towards said outlet, said valve member moving towards said cutlet orifice solely in response to fluid flow through said seat, said valve member including an enlarged generally cylindrical head facing towards said outlet orifice and a relatively smaller diameter elongated section facing towards said valve seat moving in a linear flow path within the bore into engagement with said valve seat when flow of fluid through said pump outlet is terminated, said valve member moving within said bore into engagement with said valve seat solely in response to the stoppage of fluid flow through said pump outlet.

* * * * *